US008594516B2

(12) United States Patent
Takahashi

(10) Patent No.: US 8,594,516 B2
(45) Date of Patent: Nov. 26, 2013

(54) IMAGE FORMING APPARATUS AND GENUINE PRODUCT DETERMINING METHOD FOR TONER CARTRIDGE

(75) Inventor: Makoto Takahashi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 336 days.

(21) Appl. No.: 13/039,540

(22) Filed: Mar. 3, 2011

(65) Prior Publication Data

US 2011/0217051 A1 Sep. 8, 2011

Related U.S. Application Data

(60) Provisional application No. 61/310,983, filed on Mar. 5, 2010.

(51) Int. Cl.
*G03G 15/00* (2006.01)
*G03G 15/08* (2006.01)

(52) U.S. Cl.
USPC ..... 399/12; 399/27

(58) Field of Classification Search
USPC ..... 399/12, 27, 120
See application file for complete search history.

(56) References Cited

U.S. PATENT DOCUMENTS

| | | | | |
|---|---|---|---|---|
| 2003/0055732 | A1* | 3/2003 | Nagata | 705/22 |
| 2003/0063914 | A1* | 4/2003 | Masuda et al. | 399/12 |
| 2006/0065710 | A1* | 3/2006 | Endo et al. | 235/375 |
| 2007/0297815 | A1* | 12/2007 | Takada | 399/12 |
| 2012/0002987 | A1* | 1/2012 | Odani | 399/44 |

* cited by examiner

*Primary Examiner* — Walter L Lindsay, Jr.
*Assistant Examiner* — Rodney Bonnette
(74) *Attorney, Agent, or Firm* — Turocy & Watson, LLP

(57) ABSTRACT

An image forming apparatus includes: a loading unit on which a toner cartridge is loaded, the toner cartridge having a first storage unit in which first information indicating at least a date of manufacture of toner is stored; an image forming unit which forms an image on a sheet; a counting unit which counts time; and a determination unit which determines whether the toner cartridge is a genuine product or not, based on how large a difference is between the first information and second information specified on the basis of a count result from the counting unit.

14 Claims, 9 Drawing Sheets

FIG. 4

| | |
|---|---|
| AUTHENTICATION CODE FOR TONER CARTRIDGE SHIPPED IN 2008 | 2008 |
| AUTHENTICATION CODE FOR TONER CARTRIDGE SHIPPED IN 2009 | 2009 |
| AUTHENTICATION CODE FOR TONER CARTRIDGE SHIPPED IN 2010 | 2010 |
| AUTHENTICATION CODE FOR TONER CARTRIDGE SHIPPED IN 2011 | 2011 |
| AUTHENTICATION CODE FOR TONER CARTRIDGE SHIPPED IN 2012 | 2012 |
| ⋮ | ⋮ |

IMAGE FORMING APPARATUS AND GENUINE PRODUCT DETERMINING METHOD FOR TONER CARTRIDGE

CROSS-REFERENCE TO RELATED APPLICATION

This application is based upon and claims the benefit of priority from: U.S. provisional application 61/310,983, filed on Mar. 5, 2010, the entire contents of each of which are incorporated herein by reference.

FIELD

Embodiments described herein relate generally to an image forming apparatus and the like.

BACKGROUND

Conventionally, a toner cartridge loaded in an image forming apparatus such as electrographic apparatus has an IC chip. In the IC chip, necessary data for control to prevent reduction in performance of the image forming apparatus and information for managing the toner cartridge are stored.

This information is performance information proper to disposables such as toner cartridge. It is extremely difficult for manufacturers of non-genuine products to produce the correct information. Consequently, in some cases, an IC chip as a genuine product is directly duplicated or altered and attached to other disposables such as toner cartridge and then distributed in the market with incorrect information written in the product. Users suffer disadvantages such as deterioration in image quality by continuing the use of non-genuine products by mistake. Moreover, there is a risk that the encroachment by the non-genuine products may impair the benefit to the genuine product manufacturer.

DESCRIPTION OF THE DRAWINGS

FIG. 4 is a schematic view schematically showing authentication codes.

DETAILED DESCRIPTION

Hereinafter, embodiments will be described with reference to the drawings.

According to an embodiment, an image forming apparatus includes: a loading unit on which a toner cartridge is loaded, the toner cartridge having a first storage unit in which first information indicating at least a date of manufacture of toner is stored; an image forming unit which forms an image on a sheet; a counting unit which counts time; and a determination unit which determines whether the toner cartridge is a genuine product or not, based on how large a difference is between the first information and second information specified on the basis of a count result from the counting unit.

First Embodiment

Figure 1:
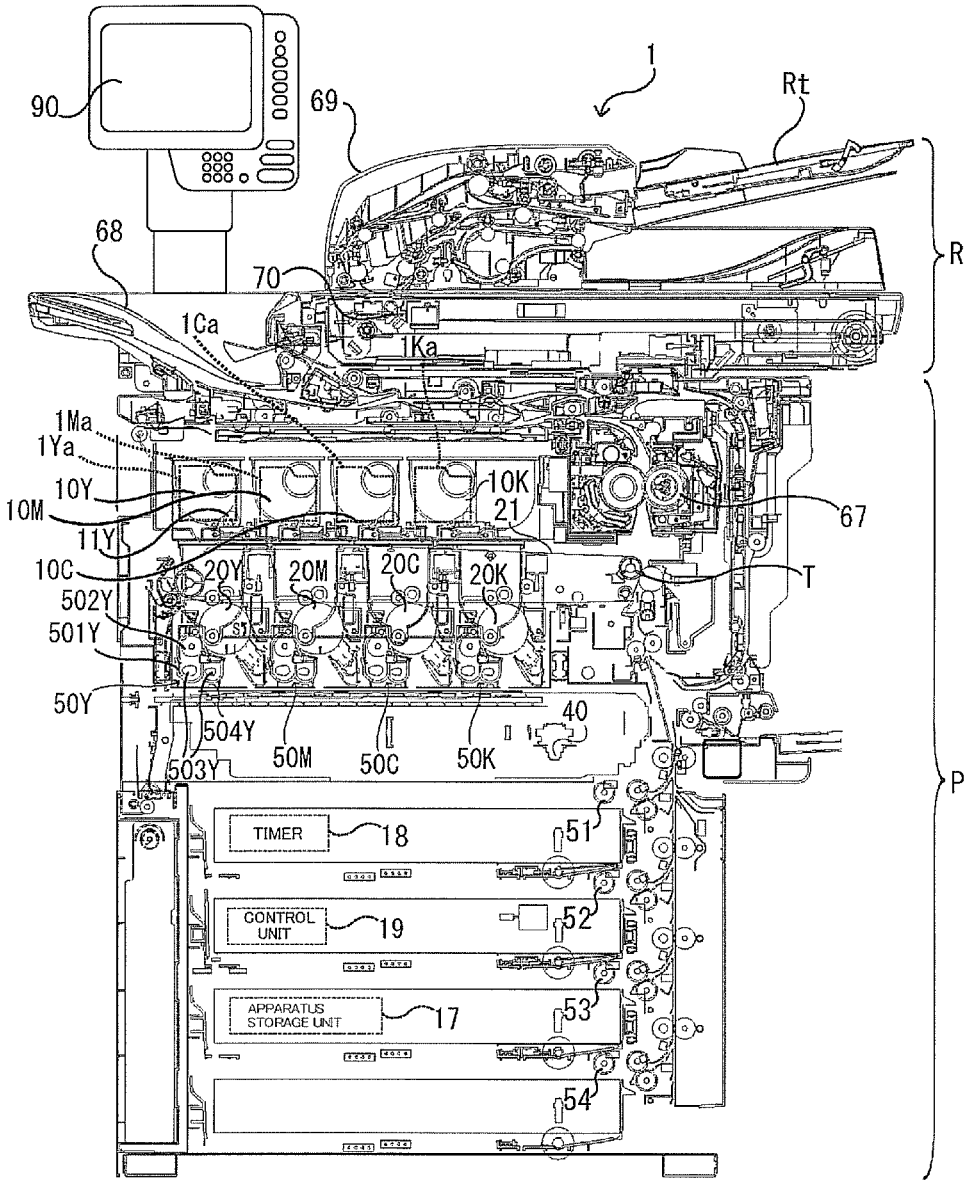
FIG. 1 is a longitudinal sectional view of an image forming apparatus.
Figure 2:
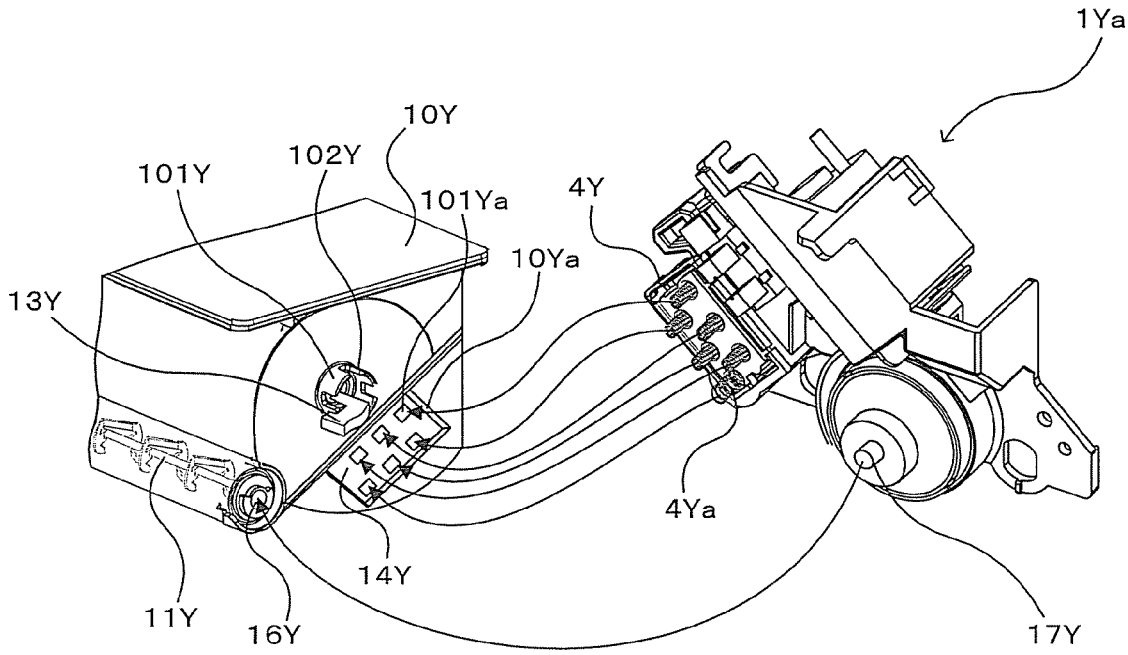
FIG. 2 is a perspective view of a loading unit which a toner cartridge is loaded on and unloaded from, and the toner cartridge.
Figure 3:
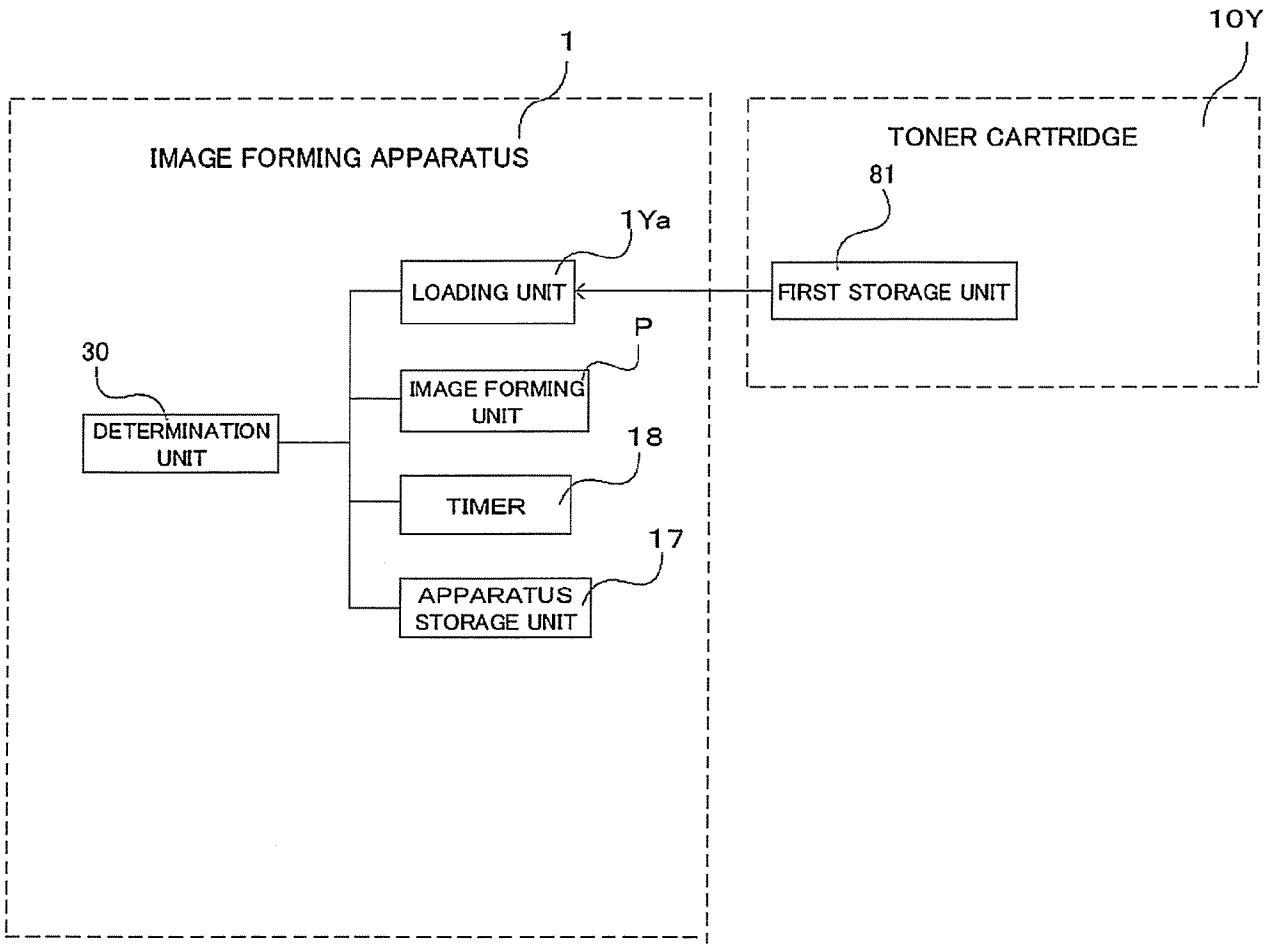
FIG. 3 is a functional block diagram of the image forming apparatus.

FIG. 1 is a longitudinal sectional view of an image forming apparatus. However, some functional blocks are indicated by dotted lines. FIG. 2 is a perspective view of a loading unit which a toner cartridge is loaded on and unloaded from, and the toner cartridge. The arrows indicate the correspondence at the time of loading. FIG. 3 is a block diagram of the image forming apparatus.

An image forming apparatus 1 has an image reading unit R and an image forming unit P. The image reading unit R scans and reads an image of a sheet document. The image forming unit P forms a developer image on a sheet based on image data of the image read by the image reading unit R. The image reading unit R has an automatic document feeder 69 which automatically carries a document to a predetermined image reading position. A scanning optical system 70 reads an image of a document placed on a document tray Rt.

The image forming unit P has pickup rollers 51 to 54, toner cartridges 10Y to 10K, photoconductive drums 20Y to 20K, developing devices 50Y to 50K, and a display unit 90.

The image forming apparatus 1 has an apparatus storage unit 17 as a second storage unit, a timer 18 as a counting unit, and a control unit 19. In the apparatus storage unit 17, various programs which are executed in the image forming apparatus 1 are stored. The apparatus storage unit 17 may be a RAM (random access memory), ROM (read only memory), DRAM (dynamic random access memory), or SRAM (static random access memory). The control unit 19 controls various operations carried out in the image forming apparatus 1. The control unit 19 may be an MPU or CPU and may include any number of MPUs and CPUs. The control unit 19 may also be an ASIC circuit which executes, in a circuit-based manner, at least a part of processing realized by the MPU and CPU. The timer 18 counts the current time. The timer 18 may also be installed inside the control unit 19.

The pickup rollers 51 to 54 supply a sheet picked up from a cassette, to a sheet carrying path. A laser unit 40 forms an electrostatic latent image on each of the photoconductive drums 20Y to 20K based on image data of an image read from a document by the image reading unit R. In the toner cartridges 10Y to 10K, developers corresponding to yellow (Y), magenta (M), cyan (C) and black (K) are housed. The developing devices 50Y to 50K supply the developers to the photoconductive drums 20Y to 20K on which the electrostatic latent images are located. The developer images located on the photoconductive drums 20Y to 20K are transferred to a belt surface of an intermediate transfer belt. The developer images on the intermediate transfer belt 21 are transferred onto the carried sheet at a secondary transfer position T. The developer images transferred to the sheet are fixed by being heated by a fixing unit 67. The sheet to which the developer images are fixed is discharged from a discharge tray 68.

The toner cartridge 10Y is detachably loaded on a loading unit 1Ya in the image forming apparatus 1. In FIG. 1, the loading unit 1Ya is indicated by dotted lines. A carrying screw 11Y slices the toner housed in the toner cartridge 10Y and carries the toner to the developing device 50Y. The carrying screw 11Y is driven by a screw motor, not shown. The driving force from the screw motor is transmitted to the carrying screw 11Y via a main-body-side transmission gear 17Y and a cartridge-side transmission gear 16Y. The control unit 19 controls the driving of the screw motor.

The toner cartridges 10M to 10K are respectively loaded on the loading units 1Ma to 1Ka in the image forming apparatus 1. In FIG. 1, the loading units 1Ma to 1Ka are indicated by dotted lines. The configuration of the toner cartridges 10M to 10K is similar to the configuration of the toner cartridge 10Y and therefore will not be described further in detail. The configuration of the loading units 1Ma to 1Ka is similar to the configuration of the loading unit 1Ya and therefore will not be described further in detail.

The toner cartridge 10Y has a cylindrical part 101Y at the center in the direction of diameter. The cylindrical part 101Y is located at one end in the longitudinal direction of the toner cartridge 10Y. The cylindrical part 101Y has cut-outs 102Y at predetermined intervals at plural positions in the circumferential direction. A number of rotations detecting unit 13Y is located in an area on the inner side of the cylindrical part 101Y in the direction of diameter and is fixed to the loading unit 1Ya. The number of rotations detecting unit 13Y may be a photo-interrupter. The number of rotations detecting unit 13Y has a light emitting element and a light receiving element. The number of rotations detecting unit 13Y detects a light receiving state where light emitted from the light emitting element and passed through the cut-out 102Y of the cylindrical part 101Y is received by the light receiving element, and a non-light receiving state where light emitted from the light emitting element is interrupted by the wall part of the cylindrical part 101Y and light reception by the light receiving element is prohibited. Thus, the number of rotations detecting unit 13Y detects the number of rotations of the screw motor. The control unit 19 is electrically connected with the number of rotations detecting unit 13Y and stores the number of rotations detected by the number of rotations detecting unit 13Y into an IC chip 14Y of the toner cartridge 10Y.

The toner cartridge 10Y has a chip fixing part 10Ya at one end face in the longitudinal direction. The IC chip 14Y is fixed to the chip fixing part 10Ya and thus integrated with the toner cartridge 10Y. The IC chip 14Y may be a RAM (random access memory). History information of toner is stored in the IC chip 14Y. The history information may include a manufacturing plant code, manufacturing lot code and classification code as well as the date of manufacture of the toner cartridge 10Y. The IC chip 14Y is attached to the chip fixing part 10Ya when the toner cartridge 10Y is manufactured. The loading unit 1Ya has a chip terminal part 4Y. The chip terminal part 4Y has plural springs 4Ya. In the state where the toner cartridge 10Y is loaded on the loading unit 1Ya, the these springs 4Ya are pressurized and contact terminal pads 101Ya of the chip fixing part 10Ya. The IC chip 14Y is located in an area which avoids the terminal pads 101Ya of the chip fixing part 10Ya.

When the screw motor stops rotating, the control unit 19 updates the number of rotations stored in the IC chip 14Y. That is, the total number of rotations of the screw motor after the toner cartridge lay is loaded in the image forming apparatus 1 is stored in the IC chip 14Y. Therefore, when the screw motor does not rotate, the control unit 19 does not update the total number of rotations stored in the IC chip 14Y.

The developing device 50Y is a magnetic brush-type and has a developing container 501Y, a developing roller 502Y, a mixer 503Y, and a toner concentration sensor 504Y as a second sensor. The developing devices 50M to 50K have a similar configuration to the configuration of the developing device 50Y and therefore will not be described further in detail. The mixer 503Y stirs the developer. The developer is made of toner and carrier for yellow. The toner may contain resin and carbon. The carrier includes ferrite and a coating layer formed on the surface of the ferrite. Since there is the coating layer on the surface of the ferrite, the triboelectric effect of the carrier and the toner becomes stable.

As the mixer 503Y stirs the developer, a frictional force is generated between the toner and the carrier. The carrier is positively charged and the toner is negatively charged. The developing roller 502Y has a magnet and its magnetic force attracts the developer, thereby forming a magnetic brush. As this magnetic brush contacts the photoconductive drum 20Y rotating in the direction of arrow S, the electrostatic latent image on the photoconductive drum 20Y becomes developed.

The toner concentration sensor 504Y detects the toner concentration based on the magnetic permeability of the developer in the developing device 50Y. That is, when the carrier ratio in the developer in the developing device 50Y is increased, the magnetic permeability becomes higher and the toner concentration sensor 504Y has a higher output value.

Next, the function of each unit in the image forming apparatus according to this embodiment will be described with reference to FIG. 3. FIG. 3 is a functional block diagram of the image forming apparatus and the toner cartridge. The following description is about the toner cartridge 10Y and the description of the other toner cartridges 10M to 10K is omitted.

The image forming apparatus 1 has a determination unit 30, a loading unit 1Ya, 1Ma, 1Ca, 1Ka, an image forming unit P, the timer 18, and the apparatus storage unit 33. The toner cartridge 10Y is loaded on the loading unit 1Ya.

The timer 18 counts the current time. In the apparatus storage unit 17, plural pieces of authentication information corresponding to each time counted by the timer 18 are stored.

FIG. 4 is an authentication code table showing an example of authentication information stored in the apparatus storage unit 17. With reference to FIG. 4, the authentication information stored in the apparatus storage unit 17 may be the year (Christian year) in which the toner cartridge 10Y is manufactured. There are plural pieces of authentication information, including not only the year when the image forming apparatus 1 is shipped, but also plural years preceding and following that year. For example, the authentication information of a toner cartridge manufactured in the year 2008 is "2008", and the authentication information of a toner cartridge 10Y manufactured in the year 2011 is "2011". This authentication information may be encrypted information such that its character information can be analyzed under predetermined rules so as to specify the year. The authentication information may also be the month of manufacture or the day of manufacture of the toner cartridge 10Y.

The determination unit 30 acquires all the authentication information that corresponds to an allowable time zone (first authentication information), from the plural pieces of authentication information stored in the apparatus storage unit 17, and determines that the toner cartridge 10Y is a genuine product when one of these pieces of authentication information is identical with first information stored in the toner cartridge 10Y. The first information will be described later.

The allowable time zone may be a period between a determination time when the determination unit 30 determines whether the toner cartridge 10Y is a genuine product or not (hereinafter referred to as "determination time") and an allowable start time before that determination time. The determination time may be a power-on time when power is turned on in the image forming apparatus 1. The determination time may also be a loading time when the toner cartridge 10Y is loaded in the loading unit 1Ya.

As the period of the allowable time zone becomes longer, the accuracy of discriminating a non-genuine product becomes lower. As the period becomes shorter, the risk of erroneously regarding a genuine product as a non-genuine product increases. Therefore, it is desirable that the allowable start time is at least in or before the previous year of the year to which the determination time belongs.

The toner cartridge 10Y has a first storage unit 81. The first information indicating the date of manufacture of the toner cartridge 10Y is stored in the first storage unit 81. The first information corresponds to the authentication information stored in the second storage unit 33. That is, if the date of manufacture is the year 2008, the same information as the authentication information stored in the apparatus storage unit 17, that is, "2008" is stored as the first information.

The determination unit 30 compares the plural pieces of authentication information stored in the apparatus storage unit 17 with the first information stored in the first storage unit 81. When there is identical information, the determination unit 30 regards the year corresponding to the identical authentication information as the year of manufacture. Moreover, the determination unit 30 determines whether the year of manufacture belongs to the allowable time zone or not, and thus determines whether the toner cartridge 10Y is a genuine product or not.

Figure 5:
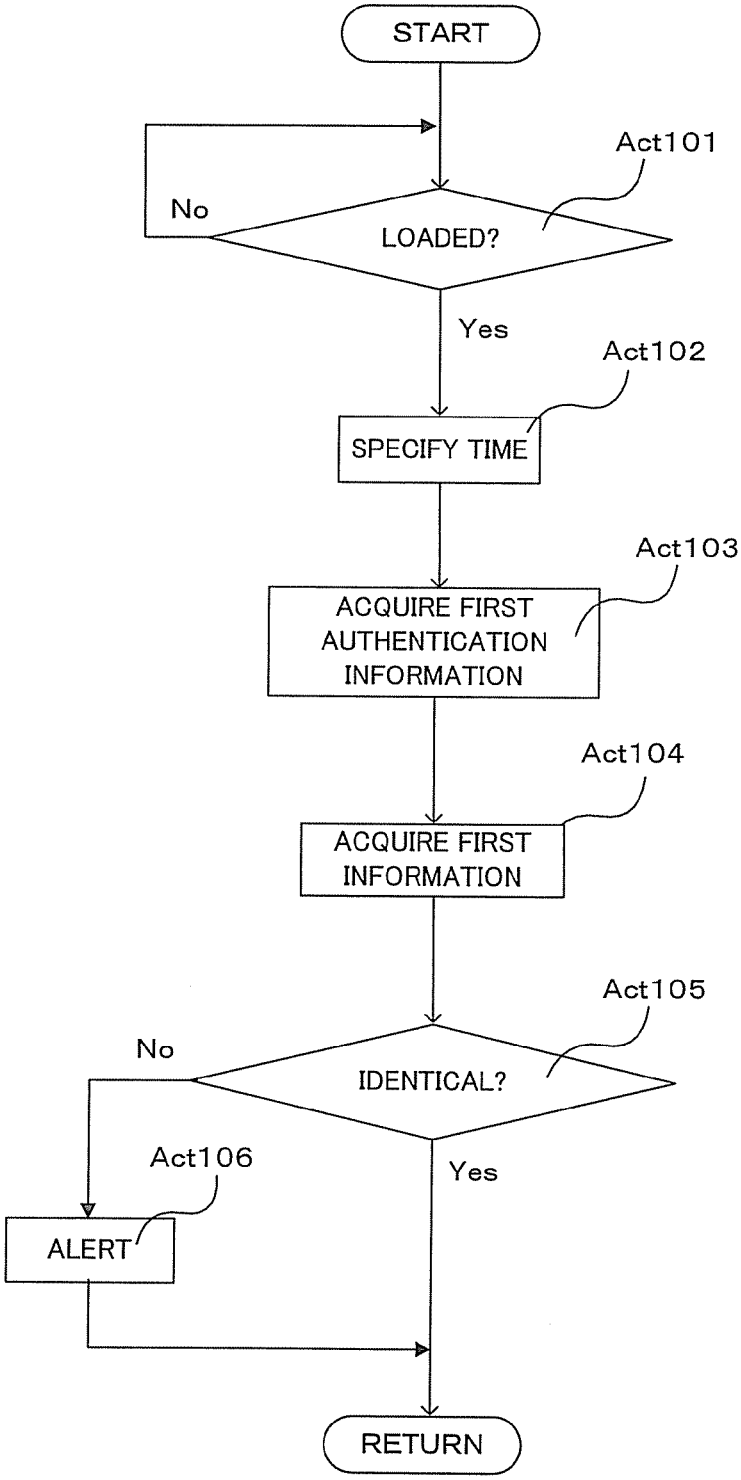
FIG. 5 is a flowchart showing a procedure for determining whether a product is a genuine product or not.

Next, the method of determining whether the toner cartridge 10Y is a genuine product or not, will be described more specifically with reference to the flowchart of FIG. 5. In ACT 101, the control unit 19 determines whether the toner cartridge 10Y is loaded on the loading unit 1Ya or not. When the toner cartridge 10Y is loaded on the loading unit 1Ya, the control unit 19 goes to ACT 102.

In ACT 102, the control unit 19 specifies the current time based on the count result from the timer 18 and goes to ACT 103. In ACT 103, the control unit 19 acquires all the authentication information belonging to the allowable time zone from the apparatus storage unit 17 and goes to ACT 104.

In ACT 104, the control unit 19 acquires the first information stored in the IC chip 14Y and goes to ACT 105. In ACT 105, the control unit 19 compares the authentication information belonging to the allowable time zone with the first information. When these pieces of information are identical, the control unit 19 returns to ACT 101. When these pieces of information are not identical, the control unit 19 goes to ACT 106.

In ACT 106, the control unit 19 displays alert information on the display unit 90. The alert information may be character information showing that the toner is not a genuine product.

Second Embodiment

Figure 6:
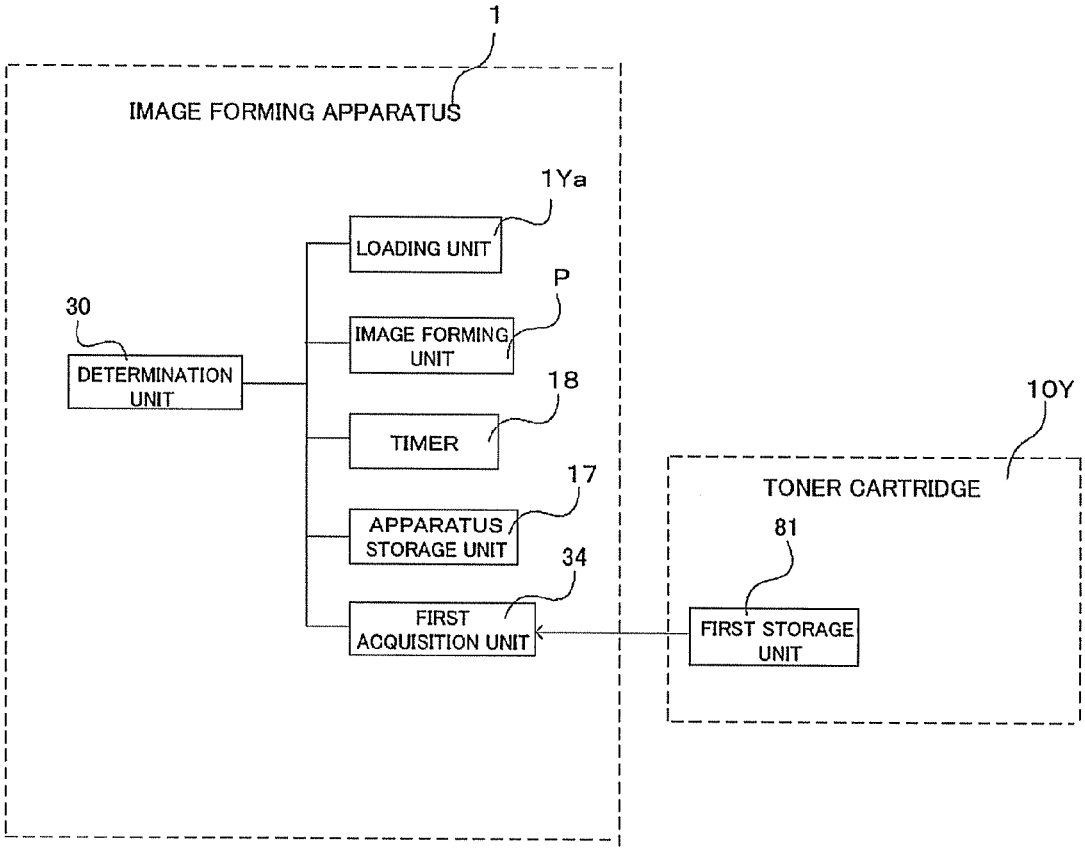
FIG. 6 is a functional block diagram of an image forming apparatus according to a second embodiment.
Figure 7:
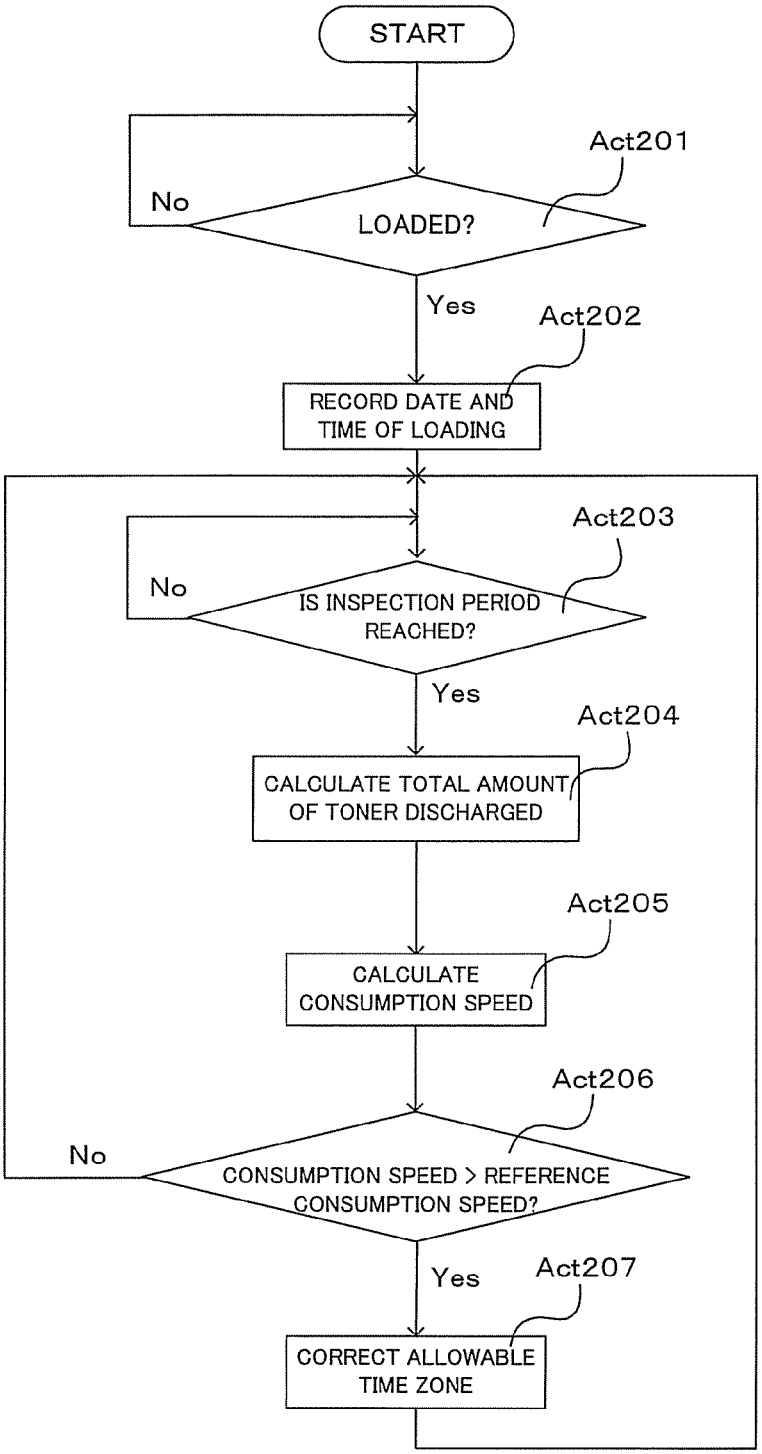
FIG. 7 is a flowchart showing a procedure for changing an allowable time zone.

An image forming apparatus according to this embodiment will be described with reference to FIG. 1, FIG. 6 and FIG. 7. FIG. 6 is a functional block diagram of the image forming apparatus according to this embodiment. FIG. 7 is a flowchart of a correcting method to correct the length of the allowable time zone.

As the period of the allowable time zone becomes longer, the accuracy of discriminating a non-genuine product becomes lower. As the period becomes shorter, the risk of erroneously regarding a genuine product as a non-genuine product increases. Depending on the user, the toner consumption speeds of the toner cartridges 10Y to 10K varies. For example, if the user intensively uses monochrome print, the consumption speed of black (K) becomes relatively faster. Thus, in this embodiment, the consumption speeds of the toner cartridges 10Y to 10K are monitored and the length of the allowable time zone is changed according to the result of the monitoring.

The following description is about the toner cartridge 10Y and the description of the other toner cartridges 10M to 10K is duplicate and therefore omitted. With reference to FIG. 6, a first acquisition unit 34 acquires speed information about the consumption speed of each amount of toner discharged from the toner cartridge 10Y.

The first acquisition unit 34 may be realized by the number of rotations detecting unit 13Y and the control unit 19 in cooperation with each other. In the IC chip 14Y, the result of detection by the number of rotations detecting unit 13Y and the date and time of loading of the toner cartridge 10Y are stored.

Therefore, the control unit 19 divides the total amount of supplied toner discharged from the toner cartridge 10Y by the elapsed time from the date and time of loading, and thus calculates the consumption speed.

With reference to FIG. 7, in ACT 201, the control unit 19 determines whether the toner cartridge 10Y is loaded on the loading unit 1Ya or not. When the toner cartridge 10Y is loaded on the loading unit 1Ya, the control unit 19 goes to ACT 202.

In ACT 202, the control unit 19 specifies the current time based on the count result from the timer 18 and stores the current time as the date and time of loading in the IC chip 14Y of the toner cartridge 10Y.

In ACT 203, the control unit 19 determines whether an inspection period is reached or not. Here, as the inspection period, a shorter time period than the typical consumption time of the toner charged in the toner cartridge 10Y may be set. That is, since the inspection period is a period provided for calculating the consumption speed of the toner, the inspection period is set to have a length from which consumption trend can be grasped.

In ACT 204, the control unit 19 reads out the result of detection by the number of rotations detecting unit 13Y from the IC chip 14Y and calculates the total amount of toner supplied. In ACT 205, the control unit 19 calculates the elapsed time from the date and time of loading and calculates the consumption speed based on the elapsed time and the total amount of toner supplied.

In ACT 206, the control unit 19 compares the consumption speed with a reference consumption speed. When the consumption speed is relatively slower, the control unit 19 goes to ACT 207. When the consumption speed is relatively faster, the control unit 19 returns to ACT 203. Here, the reference consumption speed may be defined as a designed value by the manufacturer based on the record of actual use, or may be inputted by the user operating the display unit 90.

In ACT 207, the control unit 19 extends the allowable time zone and updates the information stored in the apparatus storage unit 17. Thus, the toner cartridge 10Y, which is a genuine product, is prevented from being erroneously determined as a non-genuine product during the use of the toner cartridge 10Y. Moreover, an appropriate allowable time zone according to the consumption speed of each toner is provided.

Third Embodiment

Figure 8:
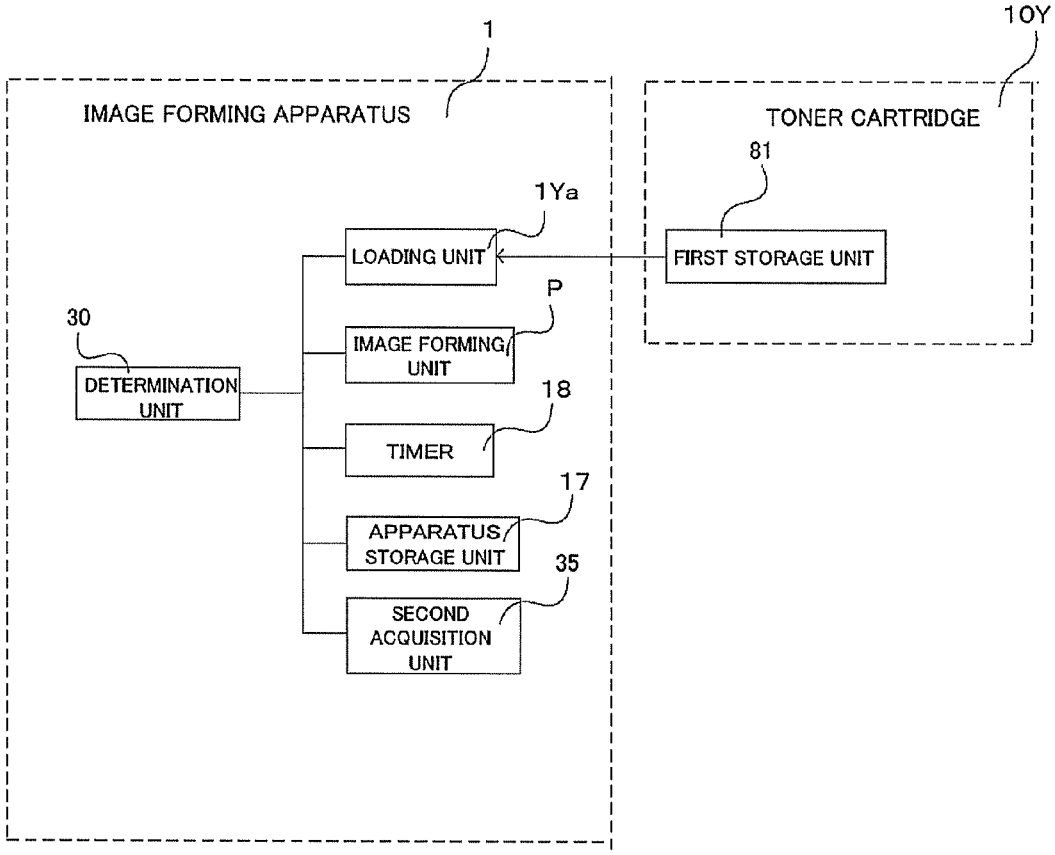
FIG. 8 is a functional block diagram of an image forming apparatus according to a third embodiment.
Figure 9:
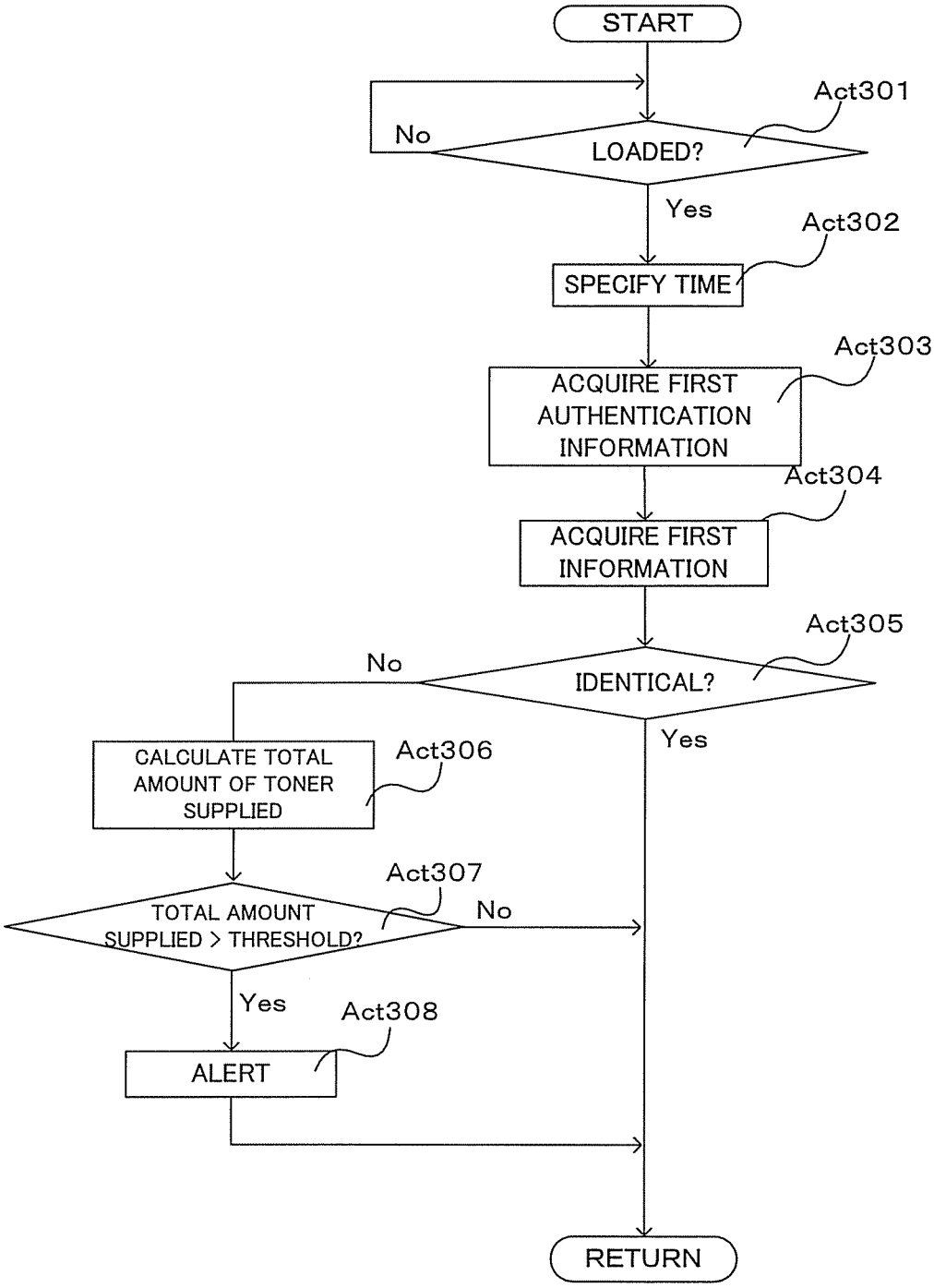
FIG. 9 is a flowchart showing a procedure for determining whether a product is a genuine product or not (third embodiment).

An image forming apparatus according to this embodiment will be described with reference to FIG. 1, FIG. 8 and FIG. 9. FIG. 8 is a functional block diagram of the image forming apparatus according to this embodiment. FIG. 9 is a flowchart of a determination method to determine whether the product is a genuine product or not.

When the life of a toner cartridge approaches the end, the amount of toner discharged from the toner cartridge may be reduced. In this case, the toner cartridge may be removed temporarily from the image forming apparatus and shaken and then reloaded in the image forming apparatus. This embodiment discloses a technique for preventing a toner cartridge from being erroneously determined as a non-genuine product when the toner cartridge is reloaded in the image forming apparatus.

The following description is about the toner cartridge 10Y. The description of the other toner cartridges 10M to 10K is duplicate and therefore omitted. With reference to FIG. 8, a second acquisition unit 35 acquires information about the total amount of toner discharged from the toner cartridge 10Y.

The second acquisition unit 35 may be realized by the number of rotations detecting unit 13Y and the control unit 19 in cooperation with each other. In the IC chip 14Y, the result of detection by the number of rotations detecting unit 13Y is stored.

With reference to FIG. 9, in ACT 301, the control unit 19 determines whether the toner cartridge 10Y is loaded on the loading unit 1Ya or not. When the toner cartridge 10Y is loaded on the loading unit 1Ya, the control unit 19 goes to ACT 302.

In ACT 302, the control unit 19 specifies the current time based on the count result from the timer 18 and goes to ACT 303. In ACT 303, the control unit 19 acquires all the authentication information belonging to the allowable time zone from the apparatus storage unit 17 and goes to ACT 304.

In ACT 304, the control unit 19 acquires the first information stored in the IC chip 14Y and goes to ACT 305. In ACT 305, the control unit 19 compares the authentication information belonging to the allowable time zone with the first information. When these pieces of information are identical, the control unit 19 returns to ACT 301. When these pieces of information are not identical, the control unit 19 goes to ACT 306.

In ACT 306, the control unit 19 calculates the total amount of toner supplied, based on the result of detection stored in the IC chip 14Y, and goes to ACT 307.

In ACT 307, the control unit 19 determines whether the total amount of toner supplied exceeds a threshold value or not. When the total amount supplied exceeds the threshold value, the control unit 19 goes to ACT 308. When the total amount supplied does not exceed the threshold value, the control unit 19 returns to ACT 301. Here, the threshold value corresponds to the total amount of toner stored in the toner cartridge 10Y.

In ACT 308, the control unit 19 displays alert information on the display unit 90. The alert information may be character information indicating that the toner is not a genuine product.

The invention can be carried out in various other forms without departing from the spirit or principal features of the invention. Therefore, the above embodiments are simply examples in every respect and should not be interpreted as limiting the invention. The scope of the invention is defined by the attached claims and is not limited by the specification. Moreover, all modifications, various improvements, alterations and changes that fall within the range of equivalents to the claims are considered to be within the scope of the invention.

What is claimed is:

1. An image forming apparatus comprising:

a loading unit on which a toner cartridge is loaded, the toner cartridge having a first storage unit in which first information indicating at least a date of manufacture of toner is stored;

an image forming unit which forms an image on a sheet;

a counting unit which counts time; and a determination unit which determines whether the toner cartridge is a genuine product or not, based on how large a difference is between the first information and second information specified on the basis of a count result from the counting unit.

2. The apparatus according to claim 1, further comprising a second storage unit in which plural pieces of authentication information, each corresponding to each time counted by the counting unit, are stored, wherein the determination unit acquires, as first authentication information, all the authentication information corresponding to an allowable time zone between a determination time of the determination unit and an allowable start time preceding the determination time, of the plural pieces of authentication information stored in the second storage unit, and determines that the toner cartridge is a genuine product when the first information stored in the first storage unit is identical with the first authentication information.

3. The apparatus according to claim 2, wherein the authentication information is encrypted information.

4. The apparatus according to claim 2, further comprising an acquisition unit which acquires speed information about a consumption speed of an amount of toner discharged from the toner cartridge, wherein the determination unit changes the allowable start time based on the speed information acquired by the first acquisition unit.

5. The apparatus according to claim 4, wherein the determination unit delays the allowable start time and shortens the allowable time zone when the speed information exceeds a reference consumption speed.

6. The apparatus according to claim 4, wherein the acquisition unit acquires a total number of rotations of a carrying screw which discharges the toner from the toner cartridge and an elapsed time from when the toner cartridge is loaded to the time of determination by the determination unit.

7. The apparatus according to claim 2, further comprising an acquisition unit which acquires information about a total amount of toner based on a total number of rotations of a carrying screw which discharges the toner from the toner cartridge, wherein the determination unit determines that the toner cartridge is a non-genuine product only when the total amount of the toner reaches an amount of toner stored in the toner cartridge.

8. The apparatus according to claim 1, wherein the determination unit carries out the determination when power is turned on in the apparatus.

9. The apparatus according to claim 1, wherein the determination unit carries out the determination when the toner cartridge is loaded.

10. The apparatus according to claim 1, wherein the first storage unit is an IC chip.

11. The apparatus according to claim 1, wherein at least manufacturing plant code information, manufacturing lot code information and classification code information are further stored in the first storage unit.

12. A genuine product determining method for a toner cartridge loaded in an image forming apparatus, comprising:

acquiring, from a toner cartridge having a first storage unit in which first information indicating at least a date of manufacture of toner is stored, the first information;

acquiring second information about time counted by a timer provided in the image forming apparatus; and determining whether the toner cartridge is a genuine product or not, based on how large a difference is between the first information and the second information.

13. The method according to claim 12, wherein the determination is carried out when power is turned on in the apparatus.

14. The method according to claim 12, wherein the determination is carried out when the toner cartridge is loaded in the apparatus.

* * * * *